United States Patent [19]

Michel

[11] Patent Number: 4,711,176

[45] Date of Patent: Dec. 8, 1987

[54] INK FOUNTAIN INCORPORATING INDIVIDUALLY REGULATED METERING SEGMENTS

[75] Inventor: Armelin Michel, London, United Kingdom

[73] Assignee: Machines Chambon, Orleans, France

[21] Appl. No.: 841,857

[22] Filed: Mar. 20, 1986

[30] Foreign Application Priority Data

Mar. 22, 1985 [FR] France ..... 85 04283

[51] Int. Cl.[4] ..... B41F 31/02

[52] U.S. Cl. ..... 101/365

[58] Field of Search ..... 101/350, 363, 364, 365, 101/355, 356

[56] References Cited

U.S. PATENT DOCUMENTS

| | | | |
|---|---|---|---|
| 3,699,888 | 10/1972 | Easoz | 101/365 |
| 4,170,177 | 10/1979 | Iida et al. | 101/365 |
| 4,392,428 | 7/1983 | Wieland | 101/365 |
| 4,442,775 | 4/1984 | Jentzsch et al. | 101/365 |
| 4,479,434 | 10/1984 | Armelin | 101/365 |
| 4,495,864 | 1/1985 | Junghans | 101/365 |
| 4,502,387 | 3/1985 | Jeschke | 101/365 |

FOREIGN PATENT DOCUMENTS

| | | |
|---|---|---|
| 0047504 | 3/1982 | European Pat. Off. . |
| 0117190 | 8/1984 | European Pat. Off. . |
| 3047689 | 9/1981 | Fed. Rep. of Germany . |

*Primary Examiner*—Charles A. Pearson
*Assistant Examiner*—Moshe I. Cohen
*Attorney, Agent, or Firm*—McAulay, Fields, Fisher, Goldstein & Nissen

[57] ABSTRACT

An ink fountain for a printing machine comprises metering segments individually adjustable to adjust the thickness of the film of ink formed between them and the inking roller. To facilitate assembly of the metering segments and to avoid infiltration of ink, the common pivot axis of the metering segments is constituted by a rod maintained clamped between aligned horizontal grooves in the various adjacent metering segments and a horizontal groove in a support of the metering segments fast with the body of the ink fountain.

5 Claims, 3 Drawing Figures

INK FOUNTAIN INCORPORATING INDIVIDUALLY REGULATED METERING SEGMENTS

BACKGROUND OF THE INVENTION

The present invention realtes to an ink fountain incorporating individually regulated metering segments, for a printing machine.

Ink fountains for printing machines are already known, which comprise a vat containing ink, this vat being defined, on one side, by a horizontal inking roller driven in rotation, on the opposite side, by a body extending parallel to the inking roller, and laterally, by two vertical cheeks. The body bears, in the immediate vicinity of the peripheral surface of the inking roller, a doctor blade parallel to the inking roller and which is formed by a succession of metering segments adjacent one another, and of which the front faces are defined, on the inking roller side, by wiping edges which extend parallel to the inking roller, at a short distance from the peripheral surface thereof, this distance being adapted to be adjusted individually for each metering segment. The end parts of the metering segments which are opposite the front faces bearing the wiping edges are fixed to the body of the ink fountain. The metering segments are actuated individually by pusher members extending through the body and which are controlled, for example, by adjusting levers or motorized assemblies. Each of these pusher members exerts a thrust on the mobile end part of the metering segment which is associated therewith. In this way, it is possible, with the aid of these pusher members, to place the wiping edge of each individual metering segment more or less close to the peripheral surface of the inking roller and thus to adjust the thickness of the film of ink passing between the wiping edge of the metering segment in question and the peripheral surface of the inking roller. Such an ink fountain is described for example in French Patent Application No. 83 01945, which corresponds to U.S. Pat. No. 4,479,434.

Due to the improved performances in inking, a continuous ink-intake system has been developed which necessitates thicknesses of the film of ink (of the order of 0.3 mm) smaller than with the conventional system employing an oscillating intake roller. This small thickness must be able to vary from 0 to 100% as a function of the conditions necessary for inking. In addition, the modern remote-control and servo-control systems themselves necessitate high-precision to make it possible to return to the same initial conditions. Certain known embodiments employ a lever which multiplies the movement between a pusher member and the segment that it controls. In a known solution of this type, such as that described in German Pat. No. 3 047 689, each metering segment forms a lever of the first type comprising a first lever arm, of short length, between the wiping edge of the metering segment and the pivot axis thereof, and a second lever arm, of long length, between the point of application of the effort of the pusher member on the metering segment and the pivot axis.

Heretofore known ink fountains of this type present numerous drawbacks such as the risk of penetration of the ink between the metering segments and between them and the common support unit or the pusher members. Seals are placed at certain points wherever possible, but without being able to avoid such penetration by clearances between the metering segments. This ink in a thin layer dries, soils and prevents operation of the ink fountain under good conditions, rendering maintenance thereof very difficult.

SUMMARY OF THE INVENTION

It is an object of the present invention to overcome these drawbacks by providing an ink fountain of particularly simple design eliminating all the intermediate elements between pusher members and segments and making it possible reliably to obtain a very high precision in the adjustment of the positions of the individual metering segments.

To this end, this ink fountain incorporating metering segments of the type mentioned hereinabove is characterized in that the common pivot axis of the metering segments is constituted by a rod maintained clamped between aligned horizontal grooves of the various adjacent metering segments on the one hand, and a horizontal groove of a support of the metering segments fast with the body of the ink fountain.

Assembly and dismantling of the metering segments and of the springs which are accessible by the front part of the ink fountain are much easier than for all the similar devices known heretofore.

There is no need for seals in order to prevent the ink from penetrating between the metering segments and between them and the common support unit, this being a considerable advantage for maintaining the machine clean.

According to the present invention, each pusher member may work not only by thrust on the metering segments but possibly in traction thereon, this enabling the springs placed between the common unit and the metering segments possible to be eliminated by simple, known means.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
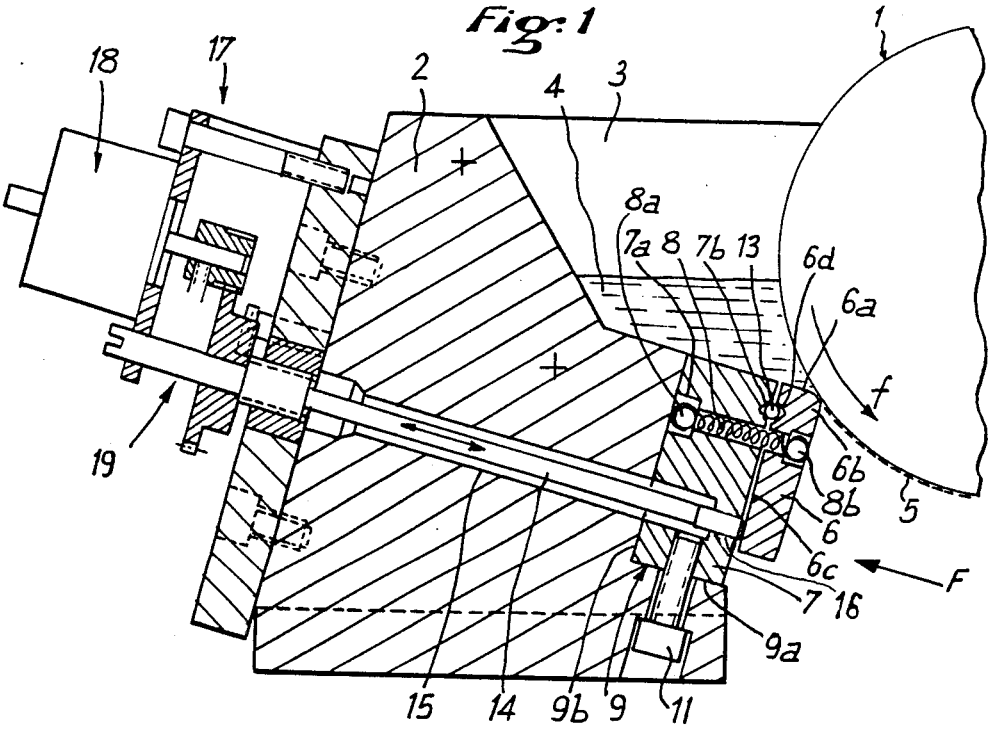
FIG. 1 is a view in vertical section perpendicular to the axis of the inking roller.
Figure 2:
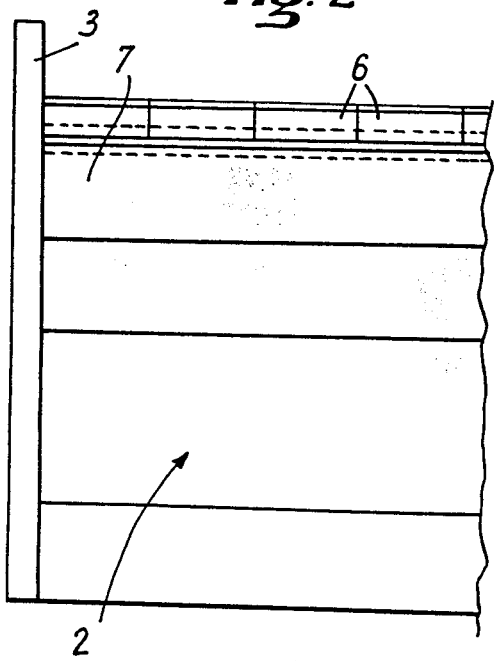
FIG. 2 is a partial plan view of the ink fountain, the inking roller and the mechanisms controlling the pusher members having been removed.

Referring now to the drawings, the ink fountain according to the invention comprises an inking roller 1 driven in rotation in the direction of arrow f, i.e. in anti-clockwise direction, a body 2 extending parallel to the axis of roller 1 and two lateral, vertical cheeks 3. Roller 1, body 2 and the two cheeks 3 constitute a vat containing a reserve of ink 4 intended to form, on the peripheral surface of inking roller 1, a film 5 of adjustable thickness.

In order to adjust the thickness of film 5, the ink fountain comprises a succession of individual metering segments 6 which are substantially coplanar, both on their front faces and on their upper faces, and are juxtaposed with respect to one another in a direction parallel to the axis of the inking roller 11, forming to some extent a doctor blade. Each of these individual metering segments 6 is constituted by a plate of parallelepipedic form, which is maintained applied against a common support unit 7, by means of a spring 8 passing through holes made in the metering segments 6 and the support unit 7. This support unit 7 is parallelepipedic in form and it is fixed on the body 2 and more particularly in a rabbet 9 therein, by means of screws 11. Rabbet 9 comprises a lower bearing face 9*a* and a perpendicular front face 9*b* against which the support unit is applied.

Each metering segment 6 comprises an upper front face 6*a* which is defined, on inking roller 1 side, by a wiping edge 6*b* located in the immediate vicinity of the peripheral surface of this roller. This wiping edge 6*b* may be sharp or it may form a bevel of small width. The various metering segments 6 are urged in the direction of the common support unit 7 via their fixing springs 8. The ends of each spring 8 may be respectively hooked to the common support unit 7 and to the associated metering segment 6 by any appropriate means, for example by means of pins 8*a* housed in holes made respectively in the common support unit 7 and the metering segment 6.

Each metering segment 6 presents, in the upper part of its left-hand inner face 6*c*, i.e. above spring 8, a horizontal groove 6*d*, of V-shaped cross-section, all the horizontal grooves 6*d* being at the same height and consequently aligned. Opposite groove 6*d* of the various metering segments 6, there extends, in the upper part of the right-hand outer face of support 7, a horizontal groove 7*b*. Between this common groove 7*b*, on the one hand, and the aligned grooves 6*d* of the various metering segments 6, on the other hand, there is housed a rod 13 constituting a common pivot axis for all the individual metering segments 6. Due to the very strong pressure exerted, under the action of springs 8, by the metering segments 6 on the rod 13 constituting the common pivot axis of these metering segments, this rod forms a tight barrier against any possible downward flow of the ink.

The lower part of the left-hand inner face 6*c* of each metering segment 6 is pressed, under the action of spring 8 tending to pivot the segment 6 in clockwise direction about rod 13, against the end of an adjusting pusher member 14. Each pusher member 14 is axially mobile in a hole 15 pierced right through body 2 and extends into a coaxial hole 16 in common support therewith. Coaxial hole 16 is pierced right through the lower part of the common support unit 7 and forms a guide for pusher member 14. The pusher member 14 projects outwardly with respect to hole 16 and its end abuts at the spot against the inner face 6*c* of segment 6, i.e. the one facing support unit 7. The other end of pusher member 14 is actuated in translation by any means such as an adjusting cam which may be driven in rotation, in manner known per se, by a lever for example, or by any other manual or motorized device. A control device 17, of the motorized type, comprising a motor 18 and a movement-transmitting mechanism 19, is shown in FIG. 1 mounted outside body 2. Rotation of motor 18 in one direction or the other consequently provokes an axial movement of the pusher member 14 which thus repels more or less the end part of the individual metering segment 6 with which it is associated. The latter, which to some extent constitutes a lever of the first type, pivots about the upper axis formed by rod 13. As the upper lever arm, defined between the pivot axis 13 and the wiping edge 6*b*, is clearly shorter than the lower lever arm defined between the pivot axis 13 and the point of application of the effort exerted by pusher member 14 on segment 6, this results in a gearing-down of the movement of the wiping edge 6*b* with respect to that of pusher member 14. In this way, it is possible to adjust with very high precision the gap defined between the wiping edge 6*b* of the individual segment 6 and the peripheral surface of the inking roller 1, and consequently to adjust the thickness of the film of ink 5 with fine precision.

As may be seen from the foregoing description, all the metering segments 6 are advantageously mounted to pivot on a support unit 7 which is in one piece and which is fixed in an interchangeable manner in the rabbet 9 of body 2. This arrangment thus makes it possible to replace the assembly of the support unit 7 and the metering segments 6 that it carries or bears, particularly when metering segments must themselves be replaced by other metering segments, in order to further prolong the operation because the operation causes wear of the wiping edges 6*b* so that they have to be replaced. Furthermore each pusher member 14 may work in traction on the lower lever arm, instead of exerting a thrust as described.

The end of each pusher member 14 may also be coupled to the associated metering segments via a link mechanism ensuring a positive control of the pivoting movements of metering segment 6 in both directions, without it being necessary to use a return spring, such as spring 12, in order to maintain permanent contact between metering segment 6 and the end of pusher member 14.

Figure 3:
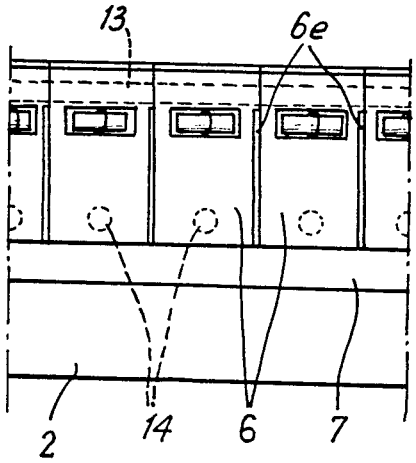
FIG. 3 is a partial front view taken in the direction of arrow F of FIG. 1.

Each metering segment 6 preferably presents, on one of its lateral faces, a slight clearance 6*e*, some tenths of millimeter in depth or in width in the direciton of alignment of the metering segments, therefore in a direction parallel to the axis of the roller and to the pivot axis 13 (FIG. 3). Each clearance extends only beneath the pivot axis 13 and it does not reach the upper face 6*a* of the segment which constitutes an extension of the bottom of the ink fountain towards roller 1. This clearance 6e makes it possible to reduce the friction between segments 6, therefore the effort on each pusher member 14, whilst ensuring tightness to the ink between the different segments 6, as the non-open upper parts, not having any clearance 6*e*, rub against one another.

I claim:

1. An ink fountain incorporating individually adjusted metering segments, for a printing machine, comprising a vat containing ink defined on one side by a horizontal inking roller driven in rotation and, on the other side, by a body extending parallel to the inking roller, and laterally by two vertical cheeks, the body of the ink fountain bearing, in the vicinity of the peripheral surface of the inking roller, a series of metering segments aligned parallel to the inking roller and each having a front face close to the inking roller, said front faces each having a wiping edge parallel to the inking roller and which determines with the peripheral surface of the inking roller, a gap, means to adjust the width of the gap to determine the thickness of the film of ink formed on the inking roller downstream of each metering segment, springs acting on said metering segments adjusting pusher member mounted to slide in the body of the ink fountain and acting against said spring on the individual metering segments, and means associated respectively with the various pusher members for displacing the latter as a function of the desired thickness of the film of ink, all the metering segments being mounted to pivot about a common axis parallel to the inking roller, each metering segment forming a lever of the first type comprising a short first lever arm, between the wiping edge of the metering segment and the pivot axis thereof, and a longer second lever arm between the point of application of the effort of the pusher member on the metering segment and the pivot axis, each of said metering segments having a horizontal groove, and a horizontal groove in said body of the ink fountain aligned with the grooves in said metering segments, the common pivot axis of the metering segments being constituted by a rod maintained clamped between said aligned horizontal grooves of the various adjacent metering segments and said horizontal groove in the body of the ink fountain.

2. An ink fountain according to claim 1, wherein each metering segment is urged in the direction of the common support by a spring passing through a hole made in the metering segment and a hole made in the support.

3. An ink fountain according to claim 2, wherein the ends of each spring are respectively hooked by means of pins housed in holes made respectively in the common support unit and the associated metering segment.

4. An ink fountain according to claim 1, wherein the rod forms a tight barrier against any downward flow of ink between the metering segments and the common support unit.

5. An ink fountain according to claim 1, wherein each metering segment presents, on one of its lateral faces, a slight clearance, some tenths of millimeter in depth or in width in the direction of alignment of the metering segments, this slight clearance extending beneath the pivot axis of the metering segments of which the non-open upper parts rub against one another.

* * * * *